US008460484B2

(12) United States Patent
Loecker et al.

(10) Patent No.: US 8,460,484 B2
(45) Date of Patent: Jun. 11, 2013

(54) METHOD OF MAKING A SHAPED OBJECT WITH REGIONS OF DIFFERENT DUCTILITY

(75) Inventors: Markus Loecker, Finnentrop (DE); Marc Horlacher, Attendorn (DE)

(73) Assignee: Kirchoff Automotive Deutschland GmbH, Attendorn (DE)

( * ) Notice: Subject to any disclaimer, the term of this patent is extended or adjusted under 35 U.S.C. 154(b) by 49 days.

(21) Appl. No.: 13/040,288

(22) Filed: Mar. 4, 2011

(65) Prior Publication Data

US 2011/0214786 A1 Sep. 8, 2011

(30) Foreign Application Priority Data

Mar. 4, 2010 (DE) ..... 10 2010 010 156

(51) Int. Cl.
*C21D 8/02* (2006.01)

(52) U.S. Cl.
USPC ..... 148/641; 148/579; 148/639; 148/643

(58) Field of Classification Search
USPC ..... 148/579, 639, 641, 643
See application file for complete search history.

(56) References Cited

U.S. PATENT DOCUMENTS 5,972,134 A 10/1999 Buschsieweke
6,023,835 A 2/2000 Kircher et al.
6,524,404 B2 2/2003 Gehringhoff
7,540,993 B2 6/2009 Reinhold
7,578,894 B2 8/2009 Reinhold
2004/0060623 A1* 4/2004 Boke et al. ..... 148/641
2007/0235113 A1 10/2007 Knaup
2009/0320968 A1* 12/2009 Boeke et al. ..... 148/546

FOREIGN PATENT DOCUMENTS

DE 102006018406 A 9/2007

* cited by examiner

*Primary Examiner* — Steven Bos
*Assistant Examiner* — Brian Walck
(74) *Attorney, Agent, or Firm* — Andrew Wilford

(57) ABSTRACT

A shaped part with different microstructures is made by continuously conveying a succession of hardenable steel blanks having first and second regions through a furnace such that the blanks reach an outlet of the furnace each with both of the respective first and second regions heated to an austenitization temperature. Then the blanks are positioned with the second regions thereof in a chamber of a holding unit and the first regions outside the chamber, and, while holding the second regions in the chamber and the first regions outside the chamber the second regions are heated and maintained at the austenitization temperature and the first regions are cooled with air to a temperature at which their microstructures become ferritic-pearlitic. Thereafter the blanks are transferred from the holding unit to a press where they are hardened and finish shaped.

9 Claims, 5 Drawing Sheets

Manipulator
1
2
4
5
6
7
10
15
19
23
24

METHOD OF MAKING A SHAPED OBJECT WITH REGIONS OF DIFFERENT DUCTILITY

FIELD OF THE INVENTION

The present invention relates to a manufacturing method. More particularly this invention concerns method of making a shaped part with regions of different ductility.

BACKGROUND OF THE INVENTION

The invention relates to a method of making a shaped part having at least two regions with different microstructure and ductility from a semifinished part, in particular a blank of hardenable steel, by heating in a continuous furnace and then hardening, where the semifinished part is heated in the continuous furnace to austenitization temperature, then a first region of the semifinished part is cooled to a temperature at which the microstructure of the region is transformed into a ferritic-pearlitic microstructure while a second region of the semifinished part is maintained at austenitization temperature, and finally the semifinished part is deformed in a press hardener into the shaped part and tempered.

From EP 1 180 470 [U.S. Pat. No. 6,524,404], a B-pillar as body part for a motor vehicle is known that is designed in the form of a longitudinal profile having a first longitudinally extending region with a predominantly martensitic material microstructure and a strength above 1400 N/mm$^2$ and a second longitudinally extending region of higher ductility with a predominantly ferritic-pearlitic material microstructure and a strength below 850 N/mm$^2$.

This document describes a workpiece configured with properties desired in the automotive industry.

DE 19 743 802 [U.S. Pat. No. 5,972,134] describes a method of making a metallic shaped part for motor vehicle parts having regions with high ductility. In this method, a blank made of suitable steel is provided that, in certain regions intended in the finished part to have a higher strength than the rest of the part, are brought in a time of less than 30 seconds to a temperature between 600° C. and 900° C. Subsequently, the heat-treated blank is deformed in a press into a shaped part. The tempering is also carried out in the press.

In this document, another procedure is described, whereby a blank is first preshaped or finish-shaped by a molding process and then certain regions of the semifinished or shaped part are heat-treated in the above-described manner. The regions then have a significantly higher strength with respect to the rest of the part. The tempering can be carried out in the press with reduced or even without shaping. If necessary, only a repressing takes place. A further procedure is described in this document, whereby the whole blank is first homogeneously heated to a temperature between 900° C. and 950° C., deformed in a press into a shaped part and is subsequently tempered. After this, a specific partial increase of the ductility in desired regions of the shaped part is carried out by partial reheating.

Such a procedure is relatively complex.

DE 102 56 621 [U.S. Pat. Nos. 7,578,894 and 7,540,993] describes a further method of making such a shaped part. According to this document, the semifinished part to be heated, for example a blank or a preformed part, is conveyed during the transport through a continuous furnace that is separated in two different temperature zones so that in one region a relatively high temperature and in another region a relatively low temperature is provided to prepare the part for the subsequent shaping and hardening. Thereafter, this part is placed into a hot shaping and hardening press to generate the finished part with the appropriate microstructure.

In such a system it is difficult to form parts with first and second regions of different lengths because the separation of the temperature zones usually is done by providing in the continuous furnace a partition that can only be displaced with considerable effort to generate differently shaped parts.

DE 10 2006 017 317 [US 2007/0235113] describes a similar method. Here, a blank or a semifinished part is heated to austenitization temperature and subsequently placed in a shaping tool with a press. Shaping the semifinished and quenching the semifinished part is carried out by contact with the shaping tool. Here, regions of the semifinished part that have to transmit deep drawing forces during the shaping are cooled in a dosed manner after heating to a temperature above austenitization temperature and prior to contact of the appropriate regions with the shaping tool without reaching in the regions the cooling rate necessary for hardening. The semifinished part is subsequently deformed and hardened in the shaping tool.

This procedure is goal-oriented; however it is relatively complex and difficult to manage.

Finally, DE 10 2006 018 406 discloses a method of heating workpieces, in particular sheet metal parts provided for press hardening, where heat is supplied to the workpiece over a period of time to heat it to a predetermined temperature. To this end, heat is dissipated during the heating from a selected region of the workpiece so that the temperature reached during the heating period in the selected region stays below the predetermined temperature. This procedure too is complicated and energy-consuming because in some cases the energy applied has to be dissipated again right away.

OBJECTS OF THE INVENTION

It is therefore an object of the present invention to provide an improved method of making a cast object with regions of different ductility.

Another object is the provision of such an improved method of making a cast object that overcomes the above-given disadvantages, in particular that is easily manageable, can be operated in an energy-efficient manner and that allows a treatment and forming of appropriate semifinished parts or blanks within the cycle rate of the press without influencing the throughput speed through the continuous furnace.

SUMMARY OF THE INVENTION

A shaped part with different microstructures is made by continuously conveying a succession of hardenable steel blanks is having first and second regions through a furnace such that the blanks reach an outlet of the furnace each with both of the respective first and second regions heated to an austenitization temperature. Then the blanks are positioned with the second regions thereof in a chamber of a holding unit and the first regions outside the chamber, and, while holding the second regions in the chamber and the first regions outside the chamber the second regions are heated and maintained at the austenitization temperature and the first regions are cooled with air to a temperature at which their microstructures become ferritic-pearlitic. Thereafter the blanks are transferred from the holding unit to a press where they are hardened and finish-shaped.

According to the invention, the continuous furnace can be operated continuously at a standard speed. After passage through the continuous furnace, the semifinished part is placed into the intermediate holding unit and is maintained therein in regions at austenitization temperature and is cooled in regions in such a manner that a ferritic-pearlitic microstructure forms. The placement of the semifinished part in the intermediate holding unit does not influence the throughput speed of the parts through the continuous furnace. After the appropriate heating or cooling of the semifinished part in the intermediate holding unit, the semifinished part is removed from the intermediate holding unit and is cyclically transferred to the hardening press for shaping and tempering. This procedure is easy to manage and can be applied without problems. Moreover, it ensures that the travel speed through the continuous furnace is not coupled in necessary dependency with the transfer to the hardening press, but a coordination of the timing is possible so that the continuous operation of the continuous furnace and the batch operation of the hardening press can be easily adapted to one another. The intermediate holding unit can be configured in different ways. For example and preferred, the intermediate holding unit is a buffer furnace that is appropriately loaded with the semifinished parts so that the second region is within the furnace chamber of the buffer furnace or in an appropriate heating region of the intermediate holding unit while the first region of the semifinished part is slowly cooled in a suitable manner to the set temperature. For example, the cooling process can take place over a time period of about 60 seconds.

It is particularly preferred here that the intermediate holding unit, in particular the buffer furnace, has in its furnace chamber a plurality of holding zones for a plurality of semifinished parts, the semifinished parts successively received from the continuous furnace each being placed in one of the holding zones and periodically transferred after partial cooling to the hardening press.

This configuration allows a plurality of semifinished parts or blanks to be held in the intermediate holding unit so that a continuous supply of semifinished parts from the continuous furnace can take place and the transfer of semifinished parts to the hardening press can be carried out corresponding to the desired cooling without the need to reduce the speed of the continuous furnace.

The holding capacity of the intermediate holding unit is adapted to the sequence of the procedure so that the hardening press can also work in the appropriate working cycle.

A possible configuration for this is that two intermediate holding units, in particular buffer furnaces, are positioned on both sides next to the output of the continuous furnace, which buffer furnaces are alternately loaded with semifinished parts that are removed from the continuous furnace.

To ensure a particularly uniform cooling of the first region of the semifinished part in a region overlapping the first region of the semifinished part, a water-cooled element is provided, the air flow serving for cooling being guided into the gap between the first region of the semifinished part and the water-cooled element, preferably sucked through the gap.

Preferably the water-cooled element extends above the whole first region of the semifinished part.

This way, a particularly uniform cooling over the entire first region is achieved.

Between the first region and the second region, automatically, a transition region is formed. The transition region has to be configured with different widths, depending on the use of the finished shaped part. To achieve this that a furnace door is provided at the outlet end of the continuous furnace and above a zone of the semifinished part that is formed between the first and second regions, the width of the zone being determined by the thickness of the furnace door.

By means of an appropriate thickness of the furnace door, the transition region thickness can be at least 40 mm and maximum 200 mm. Specifically in automotive engineering, where shaped parts are desired that have a certain crash behavior, this variable transition region is useful to ensure appropriate performance of the finished workpiece.

A possible development is that the intermediate holding unit is formed by an extension of the outlet of the continuous furnace, where, within the extension, the semifinished parts each are lifted off with the second region from the support plane of the continuous furnace and are displaced into one or more planes formed below or above, while each of the first regions is positioned such that it projects, in the transport direction of the continuous furnace, out of the continuous furnace and is cooled.

According to this configuration, the intermediate holding unit is not a separate element that, for example, is next to the outlet end of the continuous furnace, but the intermediate holding unit is generated by an extension of the outlet of the continuous furnace itself. For example, in this extension of the is continuous furnace, a positioning of the semifinished parts heated in the continuous furnace can take place in the desired manner so that the second region remains or is positioned in the appropriate region of the continuous furnace, while the first region of the semifinished parts projects out of the extension of the continuous furnace and can be cooled in this projecting region as described above. Such a configuration is advantageous in terms of energy, when, however, the continuous furnace has to be configured in a suitable manner.

As a development or alternatively the intermediate holding unit has contact faces or contact zones with different temperatures, in particular, on the one hand austenitization temperature and, on the other, a temperature at which ferritic-pearlitic microstructures are formed so that the semifinished part deposited thereon forms appropriate zones of different microstructures in different regions.

Accordingly, the intermediate holding unit can comprise heated regions and cooled regions that form contact faces or contact zones on which the semifinished part is deposited so that different regions of the semifinished part can be maintained at temperature or cooled to the desired extent.

Furthermore, the subject matter of the invention is an apparatus for making shaped parts each having two regions with different microstructures and ductilities from semifinished parts, in particular blanks of hardenable steel, the apparatus comprising a continuous furnace with a continuous conveyor by means of which the semifinished part can be transported through the continuous furnace, and a hardening press by means of which the semifinished part is tempered and deformed into a shaped part.

In order to be able to configure such an apparatus in particular for carrying out the method according to the claims 1 to 8 at least one intermediate holding unit is provided as well as at least one manipulator for handling the semifinished part by taking up the semifinished parts at the outlet end of the continuous furnace and deposited them in the intermediate holding unit, the intermediate holding unit having a first heated region for receiving a second region of the semifinished part, and a second cooled region for receiving a first region of the semifinished part, a manipulator or the manipulator further being provided that can remove the semifinished parts from the intermediate holding unit and placed them into the hardening press.

The provision of the intermediate holding unit including the appropriate manipulators ensures that, on the one hand, the continuous furnace can be operated in a continuous manner and, on the other, the hardening press can be operated in the best possible working cycle, the intermediate holding unit and the appropriate manipulators storing the corresponding shaped parts temporarily, bringing them to the desired temperature, and then shaping and tempering them in the hardening press.

In adaptation to the working cycle, one manipulator can be sufficient that picks up the shaped parts from the continuous furnace and moves them into the intermediate holding unit and also conveys the shaped parts from the intermediate holding unit into the hardening press. If the working cycle does not allow the use of a single manipulator, then it is also possible to arrange, for example, two manipulators by means of which the two transfers can be effected0.

Moreover, preferably the intermediate holding unit has a plurality of deposition locations for semifinished parts.

To simplify the handling operations the intermediate holding unit and/or the deposition locations of the intermediate holding unit is/are displaceable parallel to the transport direction of the continuous conveyor and/or transversely, in particular vertically, relative thereto.

Here, the intermediate holding unit or the deposition locations of the intermediate holding unit are configured such that they can be moved in the transport direction of the continuous conveyor, for example, toward the manipulator and away from the same. Furthermore, they are configured to be vertically adjustable so that it is possible by means of the manipulator to work always on the same horizontal plane, and the different deposition locations of the intermediate holding unit can be extend into this plane so that either shaped parts can be placed therein or shaped parts can be removed.

The deposition locations of the intermediate holding unit can comprise heatable and/or coolable contact regions onto is which a semifinished part can be placed and can be heated and/or cooled in appropriate zones.

Preferably, the intermediate holding unit is a buffer furnace whose inlet has a furnace door so that the second region of the deposited semifinished part is inside the buffer furnace and the first region outside it, a cooling being provided adjacent the first region.

As already explained above, with an appropriately dimensioned furnace door, with respect to thickness, the transition region between the two regions with different ductility is influenced, thus increased or decreased, depending on the desired shape of the shaped part.

Preferably, the cooler is a fan working with air.

Preferably, the cooler is coupled with a suction fan so that the air flow is exhausted.

Preferably, here a plate-shaped water-cooled element is provided above a support position of the first region of the semifinished part, and a gap formed between it and the region of the semifinished part is connected to the cooler, in particular to a fan with cooling air.

To achieve good absorption of the heat radiation through the water-cooled element, the surface facing the water-cooled element is colored black.

Overall, such a plate-shaped water-cooled element configured in the form of a cooling plate provides for uniform cooling that results in a homogenous microstructure in the cooled region of the shaped part.

The plate-shaped water-cooled element can preferably consist of steel with good heat conduction.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
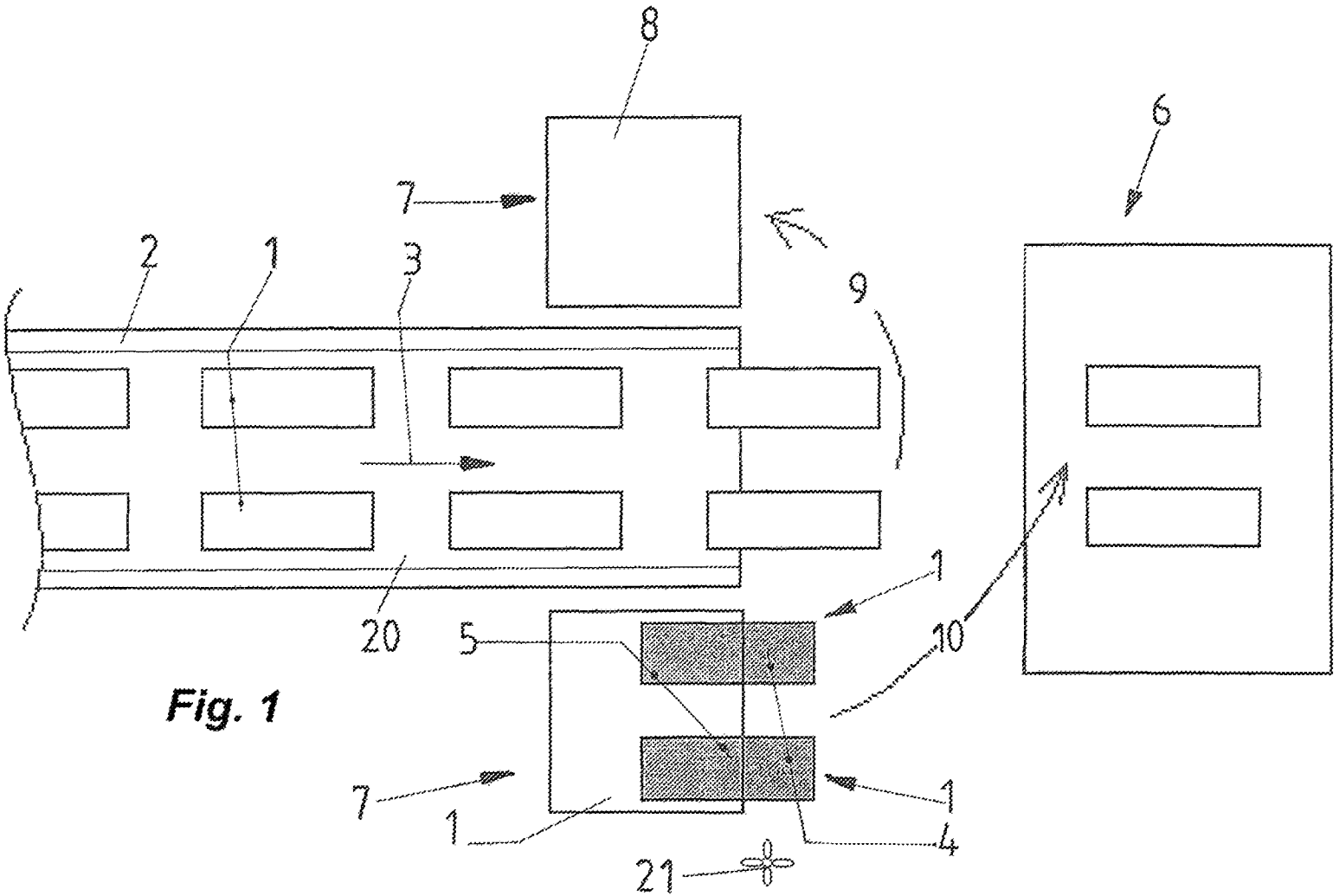
FIG. 1 is a schematic top view of a first embodiment of the invention.

The method serves for making a shaped part having at least two regions with different ductilities and microstructures from a semifinished part 1, in particular a blank of hardenable steel. A system for implementing the method consists, for example, of a continuous furnace 2 comprising a continuous conveyor 20, here the upper reach of a heat-resistant chain-type conveyor belt that extends through the continuous furnace 2 and that transports the semifinished part 1, in particular the blanks, in a travel direction 3. In the continuous furnace 2, the semifinished part 1 is heated to austenitization temperature, for example about 930° C. Subsequently, as will be explained later, a first region 4 of the semifinished part 1 is cooled to a temperature at which the microstructure of the region 4 is transformed into a ferritic-pearlitic microstructure. This takes place at about 500° C. The cooling takes place sufficiently slowly that the desired microstructure can form. A second region 5 of the semifinished part is maintained at austenitization temperature, thus at about 930° C. As soon as the appropriate microstructural transformation is completed, the semifinished part 1 is placed into a hardening press 6 and shaped and tempered therein. Such hardening presses are known in the prior art.

According to the invention, after passing through the is continuous furnace 2, the second region 5 of the semifinished part 1 is placed in a chamber of an intermediate holding unit 7, for example, a buffer furnace 8. This way, each region 5 is maintained in a respective subchamber of the holding unit 7 and is there heated to its austenitization temperature. The first region 4 projects out of the chamber of the intermediate holding unit 7. The projecting region is slowly cooled in air or with air to the temperature at which ferritic-pearlitic microstructures form. The cooling time is, for example, approximately 60 seconds. Preferably, the air that serves for cooling is pulled over the projecting end 4 by a fan 21.

The semifinished part 1 pretreated in this manner is then removed from the intermediate holding unit 7, in particular the buffer furnace 8, and transferred to the hardening press 6 for the purpose of shaping and tempering as illustrated by arrow 10.

Preferably, the intermediate holding unit, in particular the buffer furnace 8, has in its furnace chamber a plurality of holding zones or subchambers for a plurality of semifinished parts 1 so that they can be held and arranged one above one another. This way it is possible, during continuous operation of the continuous furnace 2, to place the semifinished parts 1 available at the outlet of the holding zones where they rest for an appropriate time. After an appropriate period of time, the corresponding semifinished parts can be removed periodically and transferred to the hardening press 6. Depending on the required capacity, two intermediate holding units 7 can be positioned on both sides next to the output of the continuous furnace 2 and alternately loaded with semifinished parts 1 that are removed from the continuous furnace 2.

Figures 2, 2A:
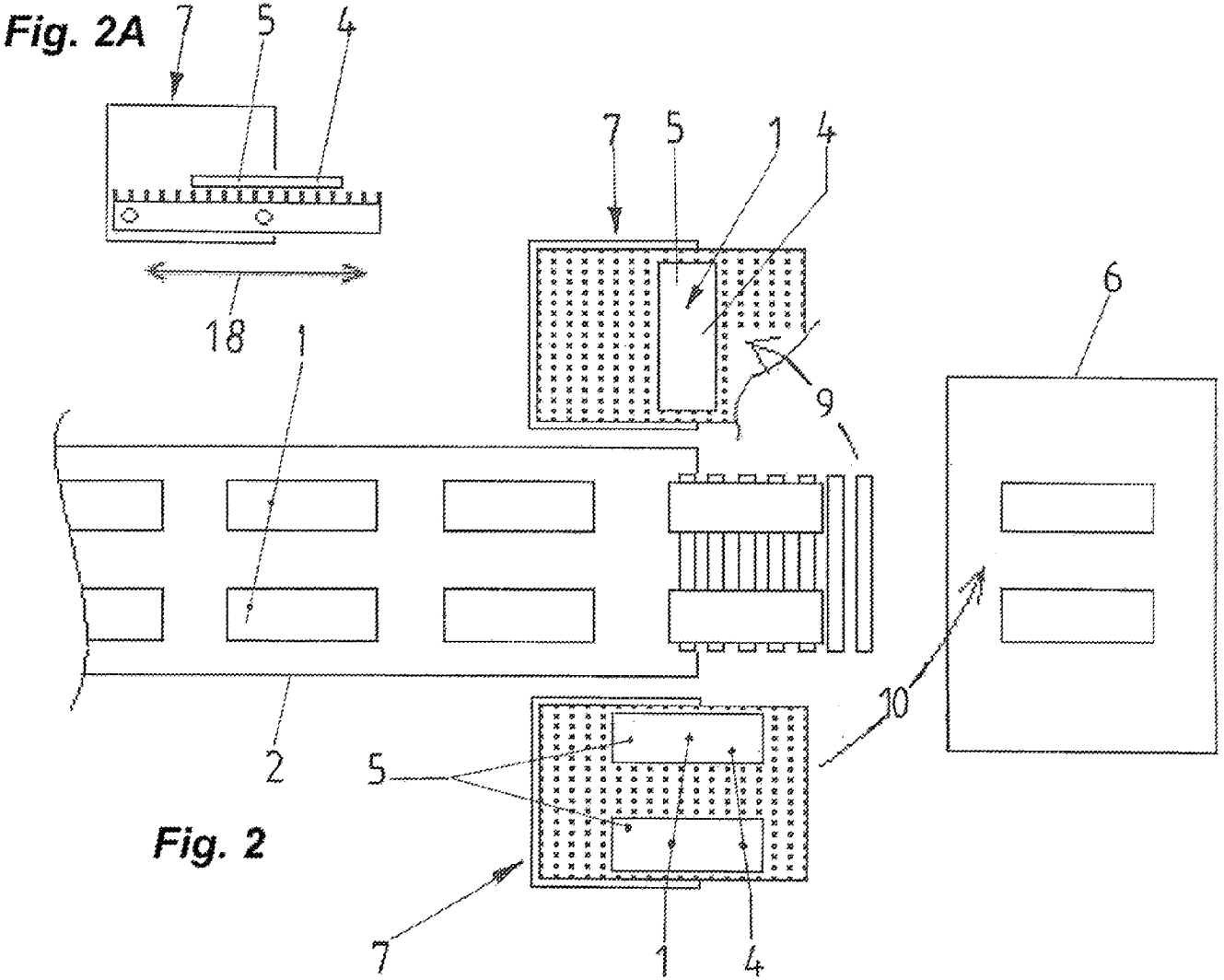
FIG. 2 is a schematic top view of a second embodiment of the invention.
FIG. 2A is a side view of a detail of FIG. 2.

FIG. 2 shows how the deposition locations of the intermediate holding unit 7 can also be adjustable parallel to the transport direction 3 in the direction of arrow 18 in order to simplify the handling operation, but also to make positioning of the semifinished part 1 easier. Also possible is vertical displacement as illustrated by arrow 19 in FIG. 3. The corresponding movements can be generated for all embodiments by corresponding actuators such as shown schematically at 23.

Figures 3, 3A:
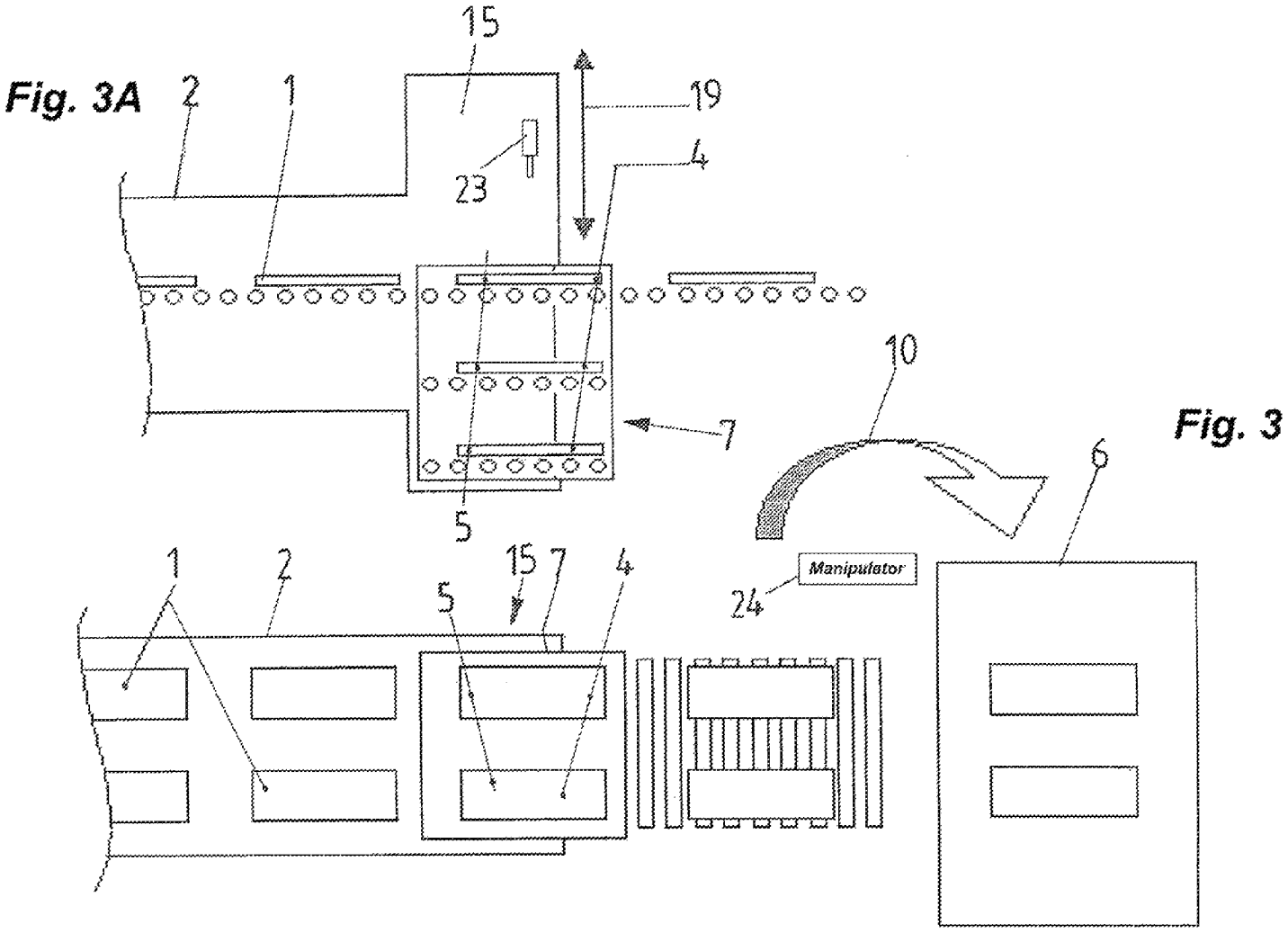
FIGS. 3 and 3A are top and side views like FIGS. 2 and 2A of a third embodiment of the invention.

As illustrated in FIG. 3, the intermediate holding unit 7 can be formed by an extension 15 of the outlet of the continuous furnace 2. Within the extension 15, the semifinished parts 1 can each be lifted off with the second region 5 from the support plane of the continuous furnace 2 or transported in a different manner transversely so that they can be displaced in a plurality of planes formed therebelow or thereabove, as illustrated in FIG. 3, where in each case the first regions 4 are positioned to project out of the continuous furnace 2 or the extension 15 in the transport direction 3 of the continuous furnace 2 and are cooled, as also illustrated in FIG. 3. In this manner it is not necessary to provide an additional buffer is furnace 8 or the like, but the continuous furnace 2 in effect forms the intermediate holding unit 7.

Figure 4:
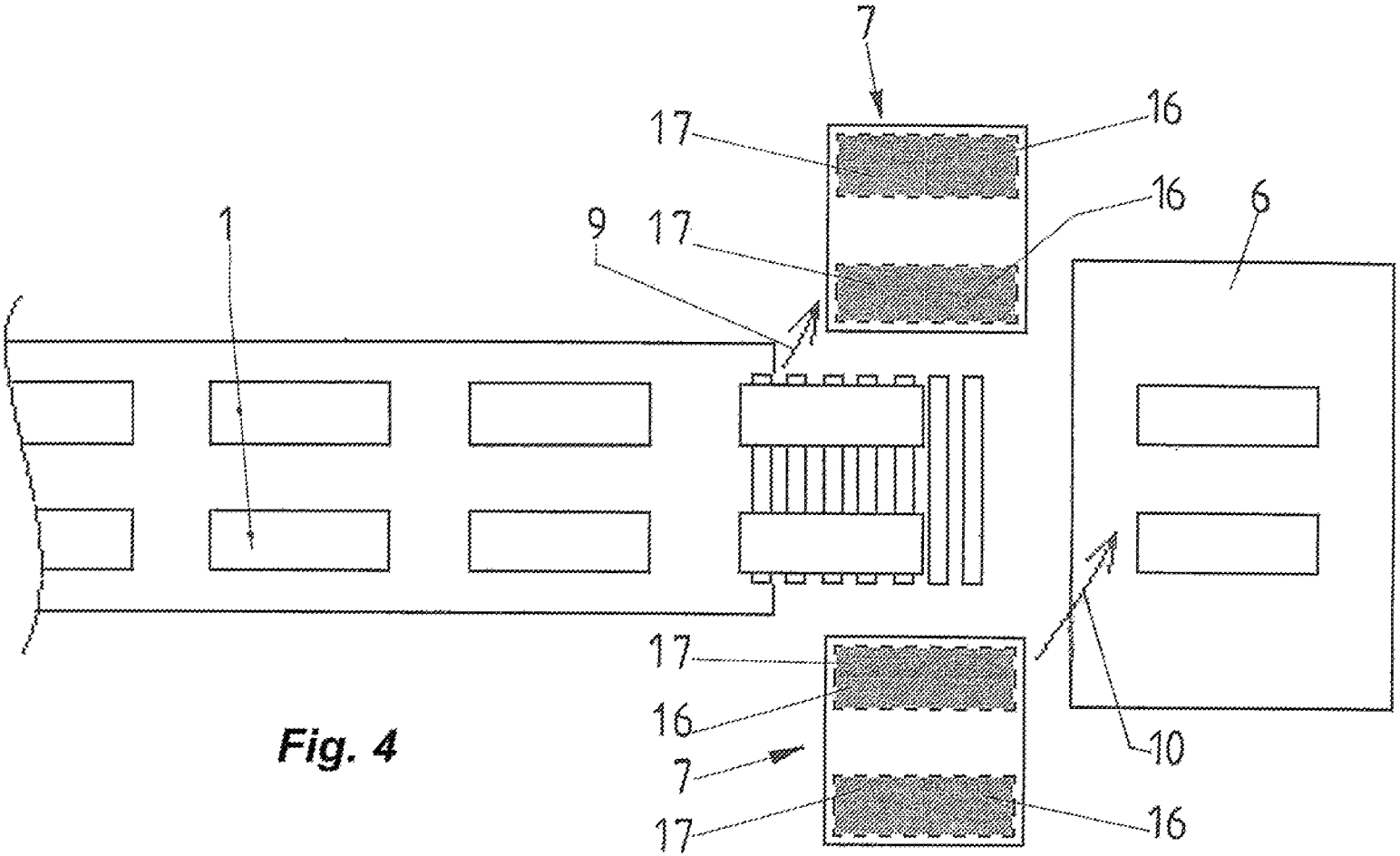
FIG. 4 is a top view of a fourth embodiment.

As illustrated in FIG. 4, an appropriate intermediate holding unit 7 can have contact faces 16 and 17 in the deposition regions of the semifinished parts 1, where each of the faces receive the semifinished parts, and where the contact faces 16 and 17 have different temperatures. Thus, on the one hand, the austenitization temperature can be maintained in the contact faces 17 while, on the other hand, in the faces 16 a lower temperature is available at which ferritic-pearlitic microstructures are formed. In this manner it is possible to provide the semifinished parts 1 placed thereon with appropriate microstructure zones in different regions and to control the temperatures of the regions 4 and 5 by direct contact with a heated or cooled surface.

Figure 6:
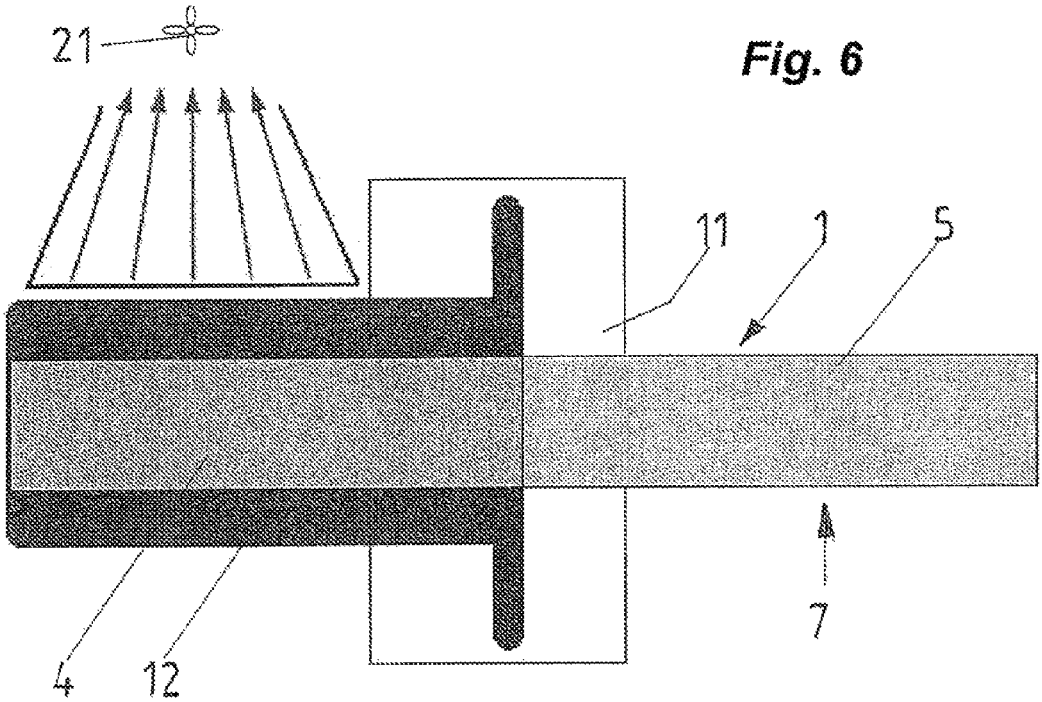
FIG. 6 is a top view of the detail shown in FIG. 5.
Figure 5:
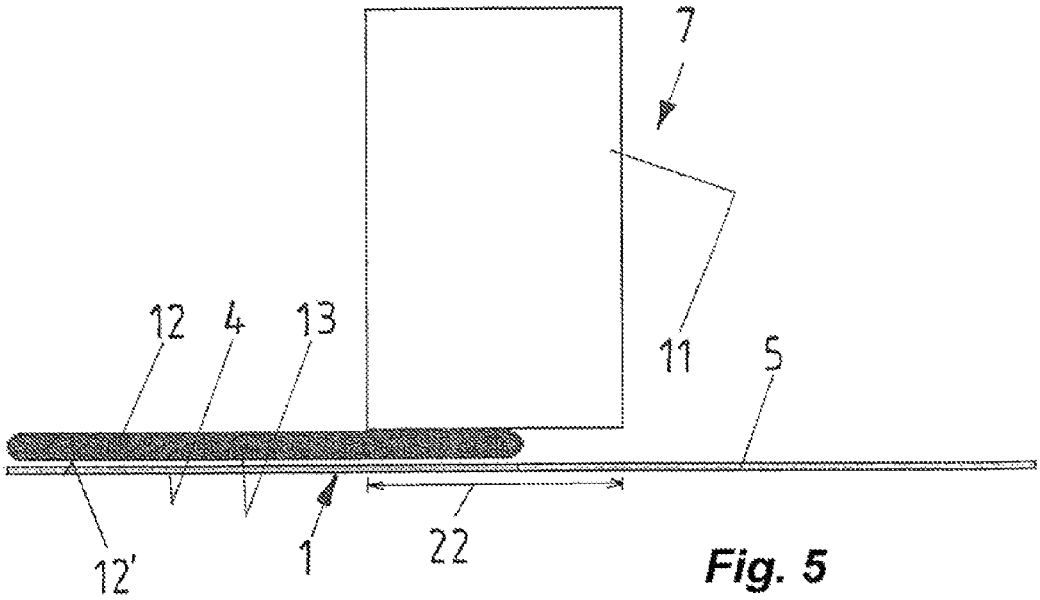
FIG. 5 is a side view of a detail of the invention.

As is clearly shown in FIGS. 5 and 6, the furnace chamber of the intermediate holding unit 7 is closed by a furnace door 11 to the outside except for a gap for passage of the semifinished part 1. Here, in the first region 4 of the semifinished part 1, a water-cooled element 12 is provided by means of which the cooling effect is enhanced. For this purpose, the air flow serving for cooling is guided through a gap 13 between the first region 4 and the water-cooled element 12, preferably sucked through the gap 13 by the fan 21, so that the cooling effect is enhanced in order to influence the desired cooling profile corresponding to the desired period of time. Preferably, the water-cooled element 12 is above the entire first region 4 of the semifinished part 1. If necessary, the water-cooled element 12 also extends partially below the region of the furnace door 11.

Changing the thickness of the furnace door 11 allows a transition region 22 that forms between the first region 4 and the second region 5 to be enlarged or reduced so that, corresponding to the requirements for the finished workpiece, it can be, for example, 40 mm or up to 200 mm. The movements indicated by the arrows 9 and 10 can be generated by manipulators such as shown schematically at 24 in FIG. 3 that are configured and provided for handling the shaped part 1. For carrying out the handling operations according to arrows 9, 10, one and the same manipulator 24 can be used if the cycle time allows it, and/or two or more separate manipulators 24 can be provided if required for achieving the required cycle time.

The water-cooled element 12 is preferably configured as a plate-shaped element of such a size that at least the first region 4 of the deposited semifinished part is completely covered. Preferably, such a plate-shaped water-cooled element 12 is made of steel that is colored black on its side 12' facing the first region 4 to be able to absorb radiant heat in a particularly good manner. Thus, depending on requirements, the appropriate semifinished parts 1, in particular blanks, can be provided with at least two regions with different microstructures and ductilities. For example, in the first region, the is temperature can be set in such a manner that a strength of 550 to 700 and, if necessary, also up to 900 N/mm$^2$ is achieved. In the second region 5, a martensitic microstructure is formed by the appropriate temperatures, so that as the final result, after the shaping in the hardening press, this region can have a strength of 1350 to 1650 N/mm$^2$.

In this embodiment, a pair of two semifinished parts 1 is conveyed in each case through the continuous furnace, the conveying speed being set in such a manner that, in a 10-second rhythm, semifinished parts can be removed at the end by manipulators 24, and then transferred into appropriate intermediate holding units 7. In the intermediate holding units 7, each of the parts stays, for example, for 60 seconds. With an appropriate number of deposition locations within the intermediate holding units, a batch loading of the hardening press 6 can be carried out so that a maximum output is allowed without the need that the continuous furnace 2 run within a specific cycle time or has to be slowed down with respect to its conveying speed.

By means of the handling operations it is possible to provide regions of the semifinished part with low or high ductility, which regions have different lengths or different widths. Also, the formation of the transition region between the regions is made possible by appropriate arrangements, in particular different furnace doors, so that even more fields of use are possible for the corresponding shaped parts produced with the method.

Apart from that, the invention is not limited to the embodiments but is variable within the context of the disclosure to a large extent.

All novel individual and combined features disclosed in the description and/or drawing are considered as being essential to the invention.

We claim:

1. A method of making a shaped part with different microstructures, the method comprising the step of:

continuously conveying a succession of hardenable steel blanks having first and second regions through a furnace such that the blanks reach an outlet of the furnace each with both of the respective first and second regions heated to an austenitization temperature;

positioning the blanks with the second regions thereof in a chamber of a holding unit and the first regions outside the chamber;

while holding the second regions in the chamber and the first regions outside the chamber heating and maintaining the second regions at the austenitization temperature and cooling the first regions with air to a temperature at which their microstructures become ferritic-pearlitic;

thereafter transferring the blanks from the holding unit to a press; and hardening and shaping the blanks in the press.

2. The method defined in claim 1 wherein the holding unit is spaced from the furnace, the method further comprising the step of:

picking the blanks up from the outlet and transferring them to the holding unit.

3. The method defined in claim 2 wherein two such holding units flank the outlet end, the blanks being transferred alternately from the outlet to the holding units.

4. The method defined in claim 1 wherein the holding unit has a plurality of subchambers, the blanks each being transferred from the furnace to a respective one of the subchambers.

5. The method defined in claim 1 wherein the first regions are cooled by juxtaposing them with a cooled element.

6. The method defined in claim 5 wherein the first regions are cooled by displacing the air between the cooled element and the first region.

7. The method defined in claim 1 wherein the furnace has at its outlet a door engageable with the blanks, the method further comprising the step of juxtaposing the door with a transition region between the first and second regions to allow the second region to be heated and the first region to be cooled.

8. The method defined in claim 1 wherein the holding unit is an extension of the outlet of the furnace, the method further comprising the step of displacing the blanks in the holding unit into vertically offset positions one above the other, with the first regions projecting out of the holding unit.

9. The method defined in claim 1 wherein the holding unit has first and second contact faces respectively at the temperatures for ferritic-pearlitic transformation and for austenitization, the method further comprising the step of contacting the first and second regions of the blanks with the faces to cool and heat them.

* * * * *